US008435403B2

(12) United States Patent
Sapper et al.

(10) Patent No.: US 8,435,403 B2
(45) Date of Patent: May 7, 2013

(54) PROCESS FOR REMOVING NITROGEN

(75) Inventors: Rainer Sapper, Aufkirchen (DE); Georg Schopfer, Munich (DE); Daniel Garthe, Aiterhofen (DE); Arndt Erik Schael, Garching an der Alz (DE)

(73) Assignee: Linde Aktiengesellschaft, Munich (DE)

( * ) Notice: Subject to any disclaimer, the term of this patent is extended or adjusted under 35 U.S.C. 154(b) by 0 days.

(21) Appl. No.: 13/148,484

(22) PCT Filed: Feb. 2, 2010

(86) PCT No.: PCT/EP2010/000615

§ 371 (c)(1),
(2), (4) Date: Oct. 20, 2011

(87) PCT Pub. No.: WO2010/091805

PCT Pub. Date: Aug. 19, 2010

(65) Prior Publication Data

US 2012/0041248 A1 Feb. 16, 2012

(30) Foreign Application Priority Data

Feb. 10, 2009 (DE) ..... 10 2009 008 229

(51) Int. Cl.
*C10G 31/06* (2006.01)

(52) U.S. Cl.
USPC ..... 208/254 R; 585/800

(58) Field of Classification Search ..... None
See application file for complete search history.

(56) References Cited

U.S. PATENT DOCUMENTS 5,125,934 A * 6/1992 Krishnamurthy et al. ..... 95/101
5,220,797 A * 6/1993 Krishnamurthy et al. ..... 62/620
5,233,839 A 8/1993 Greter
6,637,239 B2 * 10/2003 Oakey ..... 62/620
2003/0029191 A1 * 2/2003 Oakey ..... 62/620
2004/0182109 A1 * 9/2004 Oakey et al. ..... 62/620

(Continued)

FOREIGN PATENT DOCUMENTS

| | | |
|---|---|---|
| DE | 199 19 932 | 11/2000 |
| EP | 0 538 857 | 4/1993 |
| GB | 2 350 417 | 11/2000 |
| JP | 7 139874 | 6/1995 |

OTHER PUBLICATIONS

Pruitt, Craig A. "Wyoming's Shute Creek plant uses NRU unit," Oil & Gas Journal, 78-82, Oct. 9, 1989.

(Continued)

*Primary Examiner* — Tam M Nguyen
(74) *Attorney, Agent, or Firm* — Millen, White, Zelano & Branigan, P.C.

(57) ABSTRACT

A process is described for removing a nitrogen-rich fraction from a feed fraction containing essentially nitrogen and hydrocarbons, wherein the feed fraction is partially condensed and fractionated by rectification into a nitrogen-rich fraction and a methane-rich fraction.

Figure 1:
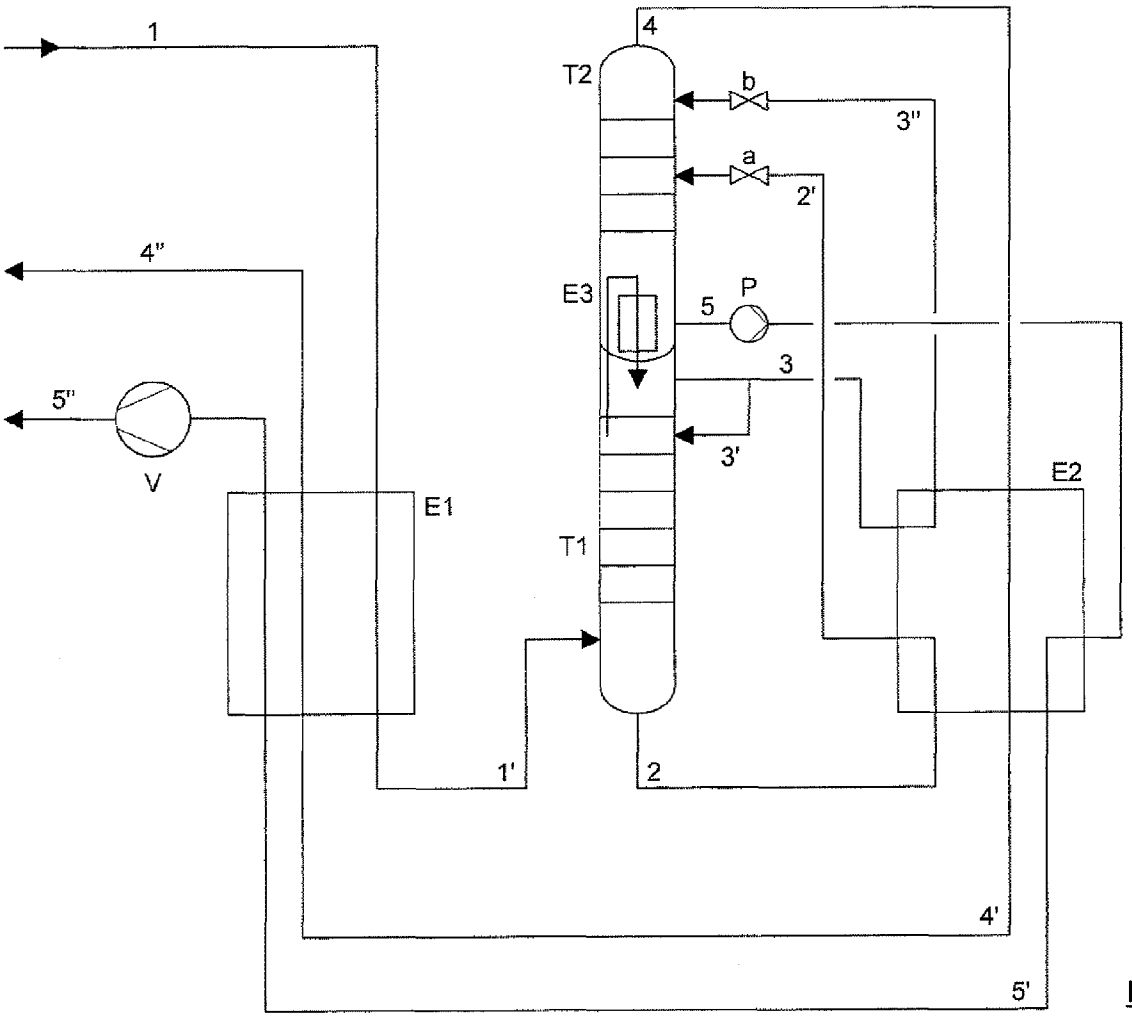

According to the invention during an interruption in the supply of the feed fraction, the separation column(s) (T1/T2) used for the fractionation by rectification and also the heat exchangers used for the partial condensation (E1) of the feed fraction and the cooling and warming of process streams occurring in the fractionation by rectification (E2) are kept by means of one or more differing cooling media (6-11) at temperature levels which correspond essentially to the temperature levels during standard operation of the separation column (s) (T1/T2) and the heat exchangers (E1, E2).

11 Claims, 4 Drawing Sheets

U.S. PATENT DOCUMENTS

| | | | | |
|---|---|---|---|---|
| 2004/0200224 | A1 | 10/2004 | Peyron | |
| 2006/0004226 | A1* | 1/2006 | Machhammer et al. | 562/526 |
| 2006/0230783 | A1* | 10/2006 | Clare et al. | 62/621 |
| 2008/0216512 | A1* | 9/2008 | Herron et al. | 62/650 |
| 2011/0277500 | A1* | 11/2011 | Bauer et al. | 62/630 |

OTHER PUBLICATIONS

Uniki Yasuo, "Manufacture of Nitrogen Gas", English Abstract of Japanese Publication No: 07139874, Publication Date: Jun. 2, 1995; Application No. 05286813; Application Date: Nov. 16, 1993; Applicant: Teisan KK. (Patent Abstracts of Japan).

International Search Report of International Patent Application No. PCT/EP2010/0006 (WO 2010/091805); Dated Feb. 14, 2013.

English Translation of EP 538857. Publication Date: Oct. 13, 2004 "Installation for the low temperature separation", Application No. EP1992118088; Application Date: Oct. 22, 1992. Inventor: Rohde Wilhelm; Applicant: Linde Ag (Thomson Innovation Record Review).

English Translation of DE 19919932. Publication Date: Nov. 2, 2004 "Procedure for winning a pure methane parliamentary group", Application No. DE19919932; Application Date: Apr. 30, 1999. Inventor: Rainer Sapper; Applicant: Linde AG (Thomson Innovation Record Review).

* cited by examiner

PROCESS FOR REMOVING NITROGEN

The invention relates to a process for removing a nitrogen-rich fraction from a feed fraction containing essentially nitrogen and hydrocarbons, wherein the feed fraction is partially condensed and fractionated by rectification into a nitrogen-rich fraction and a methane-rich fraction.

A process of the type in question for removing a nitrogen-rich fraction from a feed fraction containing essentially nitrogen and hydrocarbons may be described hereinafter with reference to the process shown in FIG. 1.

The feed fraction which contains essentially nitrogen and hydrocarbons is introduced via line 1, which feed fraction originates, for example from an upstream LNG plant. Said feed fraction preferably has a pressure which is greater than 25 bar. It was optionally subjected to a pretreatment, such as desulfurization, carbon dioxide removal, drying etc. In the heat exchanger E1 it is cooled and partially condensed against process streams which will be considered in more detail hereinafter. Downstream of the valve d the partially condensed feed fraction is subsequently fed via line 1' to a high-pressure column T1.

This high-pressure column T1, together with the low-pressure column T2, forms a double column T1/T2. The separation columns T1 and T2 are thermally coupled via the condenser/reboiler E3.

From the bottom of the high-pressure column T1, a hydrocarbon-rich liquid fraction is taken off via line 2, subcooled in heat exchanger E2 against process streams which will be considered in more detail hereinafter and subsequently fed via line 2' and expansion valve a to the low-pressure column T2 in the upper region.

Via line 3, a liquid nitrogen-rich fraction is taken off from the upper region of the preseparation column T1. A substream of this fraction is added to the preseparation column T1 via line 3' as reflux. The nitrogen-rich fraction which is taken off via line 3 is subcooled in the heat exchanger E2 and fed via the line 3" and expansion valve b to the low-pressure column T2 above the feed-in point of the described methane-rich fraction.

Via line 4, a nitrogen-rich gas fraction is taken off at the top of the low-pressure column T2. The methane content thereof is typically less than 1 mol %. In the heat exchangers E2 and E1 the nitrogen-rich fraction is subsequently warmed and optionally superheated before it is taken off via line 4" and discharged into the atmosphere or optionally fed to another use.

Via line 5, a methane-rich liquid fraction which, in addition to methane, contains the higher hydrocarbons contained in the feed fraction, is taken off from the bottom of the low-pressure column T2. The nitrogen content of said methane-rich liquid fraction is typically less than 5 mol %. The methane-rich fraction is pumped by means of the pump P to a pressure as high as possible—this is customarily between 5 and 15 bar. In the heat exchanger E2 the methane-rich liquid fraction is warmed and optionally partially evaporated. Via line 5' it is subsequently fed to the heat exchanger E1 and in this completely vaporized and superheated against the feed fraction which is to be cooled.

Using the compressor V, the methane-rich fraction is subsequently compressed to the desired delivery pressure, which is generally more than 25 bar, and taken off from the process via line 5".

Processes of the type in question for removing a nitrogen-rich fraction from a feed fraction containing essentially nitrogen and hydrocarbons are implemented in nitrogen rejection units (NRUs). Nitrogen is removed from nitrogen/hydrocarbon mixtures whenever an elevated nitrogen content prevents the use in accordance with specifications of the nitrogen/hydrocarbon mixture. Thus, for example, a nitrogen content of greater than 5 mol % exceeds typical specifications of natural gas pipelines in which the nitrogen/hydrocarbon mixture is transported. Gas turbines also can only be operated up to a defined nitrogen content in the combustion gas.

Such NRUs are generally similar to an air fractionator having a double column such as described, for example, with reference to FIG. 1, constructed as a central process unit and generally arranged in what is termed a cold box.

Depending on the field of use, the availability of an NRU can be of great importance. An obstacle for high availability is the long period of time which is required in order to restart the process after loss of the feed fraction (NRU feed gas) containing essentially nitrogen and hydrocarbons. Losses of the NRU feed gas can occur, depending on the upstream processes or plants, several times per year, for example due to the loss of an upstream NRU feed gas compressor or an upstream LNG/NGL plant. Furthermore, faults can occur within the NRU which make interruption of the feed of the NRU feed gas necessary.

In this connection, a distinction must be made between restarting from the warm state (warm start-up) and from the cold state (cold restart). The warm start-up is comparatively time consuming, since all of the equipment must again be cooled down to cryogenic temperatures and the liquid levels in the process must be built up. A cold restart after comparatively short losses of the NRU feed gas—these are taken to include outage times between a few minutes and 24 hours—from the cold state can be carried out relatively quickly, in contrast.

During the idle time of the NRU, owing to unavoidable insulation losses, warming of the separation column(s) and also the heat exchangers, lines, etc. occurs. After a certain warming time, which is determined by the plant size and the ambient conditions, a cold restart is no longer possible. The reason therefor lies in the necessarily occurring impermissible mechanical stresses which occur when the (partially) warmed heat exchangers are charged with cold liquids or gases from the process. In such a case, the NRU must therefore be warmed to ambient temperature before a warm start-up can be carried out.

In the case of longer losses of the NRU feed gas, which can be caused by plant faults or maintenance work, the NRU must therefore be warmed completely, before a time-consuming warm start-up can be carried out. This procedure can in some circumstances last for longer than one week. This long warm start-up time is lost as production time and can therefore lead to considerable financial losses. This is the case, in particular, when the NRU is integrated into other plants, the production of which is dependent on the ability of the NRU to function; mention may be made by way of example of LNG plants having a combustion gas preparation for gas turbines by the NRU.

It is an object of the present invention to specify a process of the type in question for removing a nitrogen-rich fraction from a feed fraction containing essentially nitrogen and hydrocarbons which avoids the described disadvantages.

For achieving this object, a process of the type in question for removing a nitrogen-rich fraction from a feed fraction containing essentially nitrogen and hydrocarbons is proposed, which is characterized in that, during an interruption in the supply of the feed fraction, the separation column(s) used for the fractionation by rectification and also the heat exchangers used for the partial condensation of the feed fraction and the cooling and warming of process streams occurring in the fractionation by rectification are kept by means of one or more differing cooling media at temperature levels which correspond essentially to the temperature levels during standard operation of the separation column(s) and the heat exchangers.

The wording "held at a temperature level which corresponds essentially to the temperature level during standard operation" is taken to mean a temperature level which differs by no more than 20 K from the temperature level which prevails during standard operation and which ensures that no disadvantages associated with warming of the separation column(s) and/or the heat exchangers occur.

A further advantageous embodiment of the process according to the invention for removing a nitrogen-rich fraction from a feed fraction containing essentially nitrogen and hydrocarbon is characterized in that the cooling medium used is a hydrocarbon-rich fraction, preferably liquefied natural gas (LNG), boil-off gas, liquid and/or gaseous nitrogen.

According to the invention, during an interruption in the supply of the feed fraction, the NRU is then kept cold by the separation column(s), lines, pumps, heat exchangers, etc., of the NRU being cooled during the interruption time period by supplying one or more differing cooling media.

The process according to the invention for removing a nitrogen-rich fraction from a feed fraction containing essentially nitrogen and hydrocarbons, and also other advantageous embodiments of the same which are subjects of the dependent patent claims will be described in more detail hereinafter with reference to the exemplary embodiments shown in FIGS. 2 to 4.

Hereinafter, in the explanation of the exemplary embodiments shown in FIGS. 2 to 4, only the differences from the procedure shown in FIG. 1 will be considered.

Figure 2:
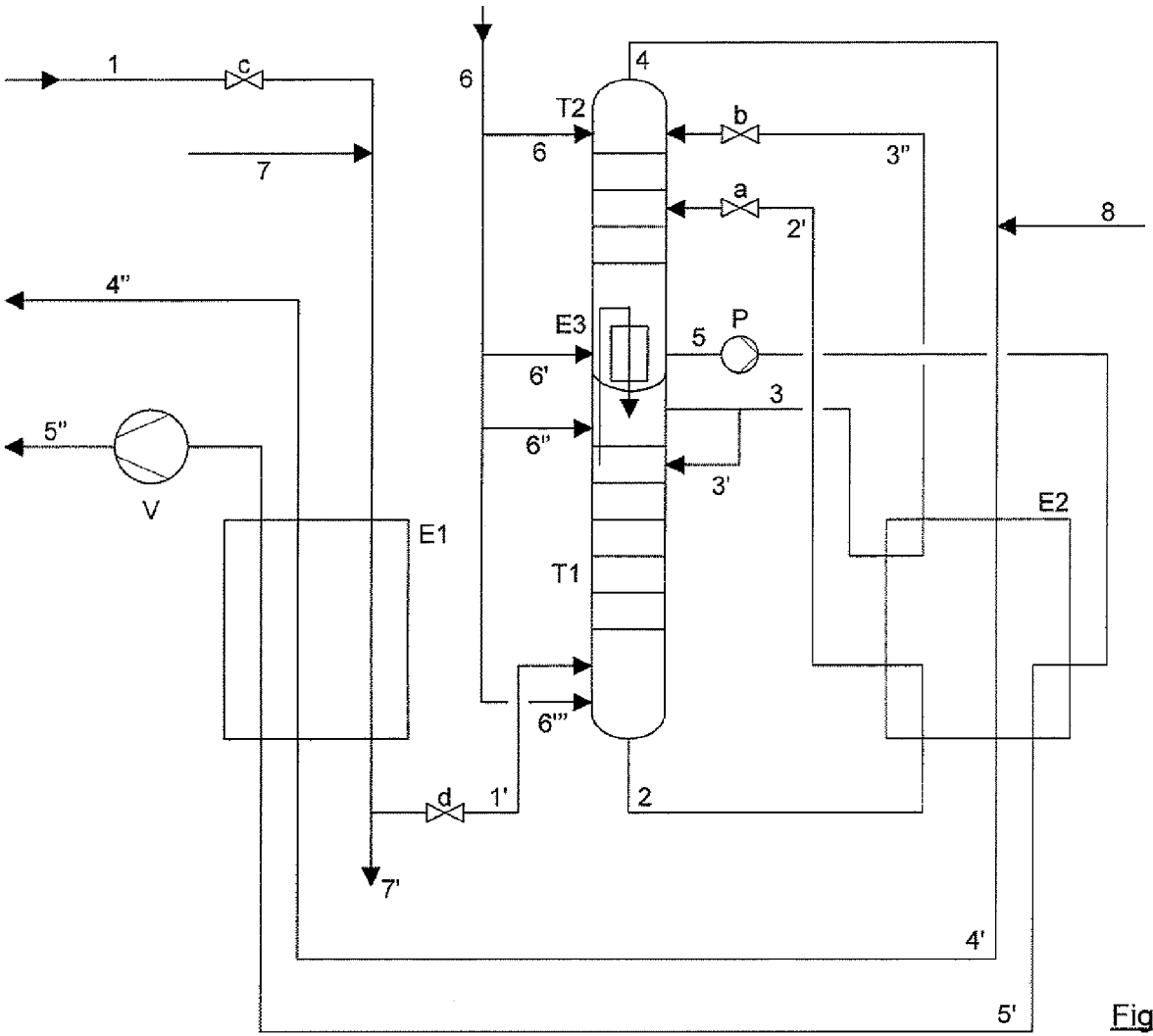

In the embodiment of the process according to the invention shown in FIG. 2 a cooling medium, preferably liquefied natural gas (LNG), which is suitable for cooling the columns T1 and T2 is supplied to the double separation column T1/T2 during the interruption of the supply of the feed fraction via the lines 6 to 6'''—the valves c and d in line 1 and 1' are closed during this time period. The control valves by means of which the cooling medium rates can be controlled and which are provided in lines 6 to 6'''—are not shown in FIGS. 2 to 4.

The supply of liquefied natural gas via lines 6 and 6' to the low-pressure column T2 is of particular importance in this case, since in the event of heating of this column the vaporized liquid in it must be released to the atmosphere or to a flare system. If warming of the high-pressure column T1 occurs and associated vaporization of the liquid present in it, the resultant gas would condense again owing to the condenser E3. However, this back-condensation functions only while a sufficiently large and cold amount of liquid is present in the bottom of the separation column T2. Nevertheless, in the case of a relatively long interruption, supply of cooling medium via the lines 6'' and 6''' to the column T1 is also necessary, or at least expedient. In particular, leaks at the valves a and b lead to liquid losses in the high-pressure column T1 in the case of relatively long stoppage times.

Via the lines 7,1 and 7', a cooling medium is conducted through the heat exchanger E1. This cooling medium must have a temperature which is similar to the temperature which the feed fraction has which is fed in standard operation to the heat exchanger E1 via the line 1. The cooling medium used is advantageously warm, gaseous nitrogen. After passage through the heat exchanger E1 the nitrogen is released to the atmosphere via line 7'.

In addition, a cooling medium is passed through the heat exchangers E2 and E1 via the line sections 8, 4' and 4''. This cooling medium which is advantageously cold, gaseous nitrogen, has a temperature which is similar to the temperature of the nitrogen-rich stream which is taken off in standard operation via line 4. The supply of the cooling medium or media to the heat exchangers E1 and E2 must be arranged in practice in such a manner that the lines between the heat exchangers and the columns are co-cooled as completely as possible.

By means of the described cooling media streams, the temperature profiles of the columns T1/T2 and also of the heat exchangers E1/E2 can be held during the interruption time period, and so after termination of the interruption time period a rapid restart of the separation process and of the NRU can be achieved without unwanted thermal stresses occurring in the materials of the columns, heat exchangers etc.

Figure 3:
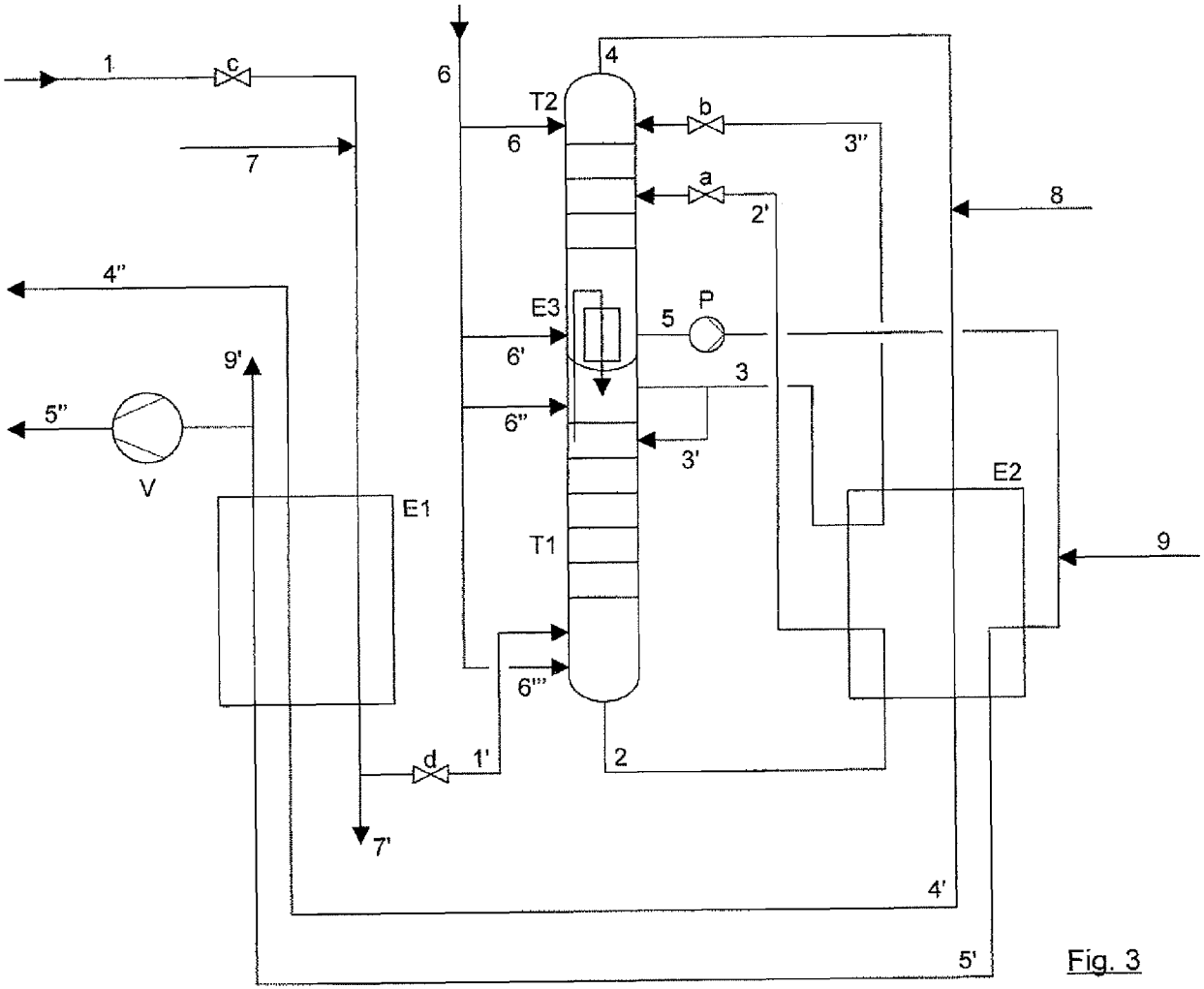

In the embodiment of the process according to the invention shown in FIG. 3, a further cooling medium is passed through the heat exchangers E2 and E1 via the line sections 9, 5' and 9'. In this case the cooling medium used is preferably cold, gaseous nitrogen or liquefied natural gas. By means of this embodiment, holding the separation process or the NRU cold is additionally supported.

Figure 4:
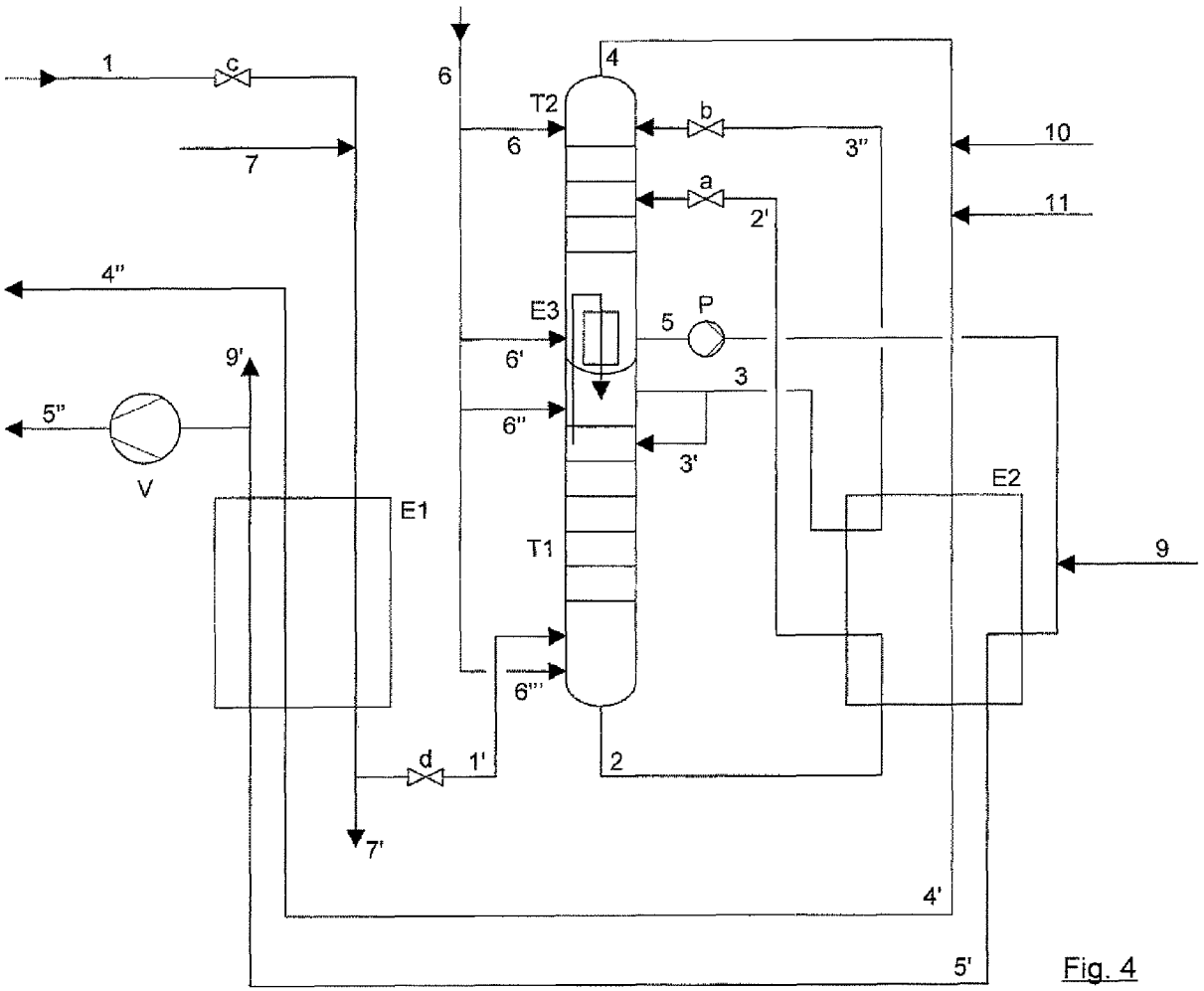

A further advantageous embodiment of the process according to the invention is shown in FIG. 4. In this, warm, gaseous nitrogen and liquefied natural gas are mixed via lines 10 and 11 and are supplied via line 12 to the line section 4 and passed through the heat exchangers E2 and E1 via the line sections 4' and 4''. The supply of a further cooling medium via line 9, as has been described hereinbefore, can be implemented optionally. The embodiment of the process according to the invention shown in FIG. 4 has the advantage that the frequently complex provision of cold nitrogen can be avoided.

It is obvious that in addition to the mentioned liquefied natural gas and nitrogen, other single- or multicomponent gaseous or liquid media can be used as cooling media. In the event of incorporation of the separation process or of the NRU into an LNG or NGL plant, boil-off gas occurring can also be used as cooling medium.

By means of the procedure according to the invention, then, even after relatively long interruptions of the supply of the NRU feed gas, rapid restart of standard operation can be achieved since the apparatuses forming the NRU (separation columns, heat exchangers etc.) can be held by means of the cooling medium or cooling media at the temperature levels which correspond essentially to the temperature levels during standard operation of the NRU.

The increased resource in terms of apparatus and process which are required for the process according to the invention, including the provision of the cooling medium or cooling media required, is comparatively low, and so the advantages achieved by the process according to the invention without doubt justify this increased resource.

The invention claimed is:

1. A process for removing a nitrogen-rich fraction from a feed fraction containing essentially nitrogen and hydrocarbons, wherein the feed fraction is partially condensed in one or more heat exchangers and fractionated by rectification in one or more separation columns into a nitrogen-rich fraction and a methane-rich fraction, said process comprising:

during an interruption in the supply of the feed fraction, said one or more separation columns used for the fractionation by rectification and also said one or more heat exchangers E1 used for partial condensation of the feed fraction and one or more heat exchangers E2 used for cooling and warming of process streams occurring in the fractionation by rectification are kept, by means of one or more differing cooling media, at temperature levels which correspond essentially to the temperature levels during standard operation of said one or more separation columns, said one or more heat exchangers used for partial condensation of the feed fraction, and said one or more heat exchangers used for cooling and warming of process streams occurring in the fractionation by rectification.

2. The process as claimed in claim 1, wherein a hydrocarbon-rich fraction, boil-off gas, liquid and/or gaseous nitrogen is used as said one or more differing cooling media.

3. The process according to claim 1, wherein liquefied natural gas, boil-off gas, liquid and/or gaseous nitrogen is used as said one or more differing cooling media.

4. The process according to claim 1, wherein said one or more separation columns comprise a high-pressure column T1 and a low-pressure column T2.

5. The process according to claim 4, wherein said high-pressure column T1 and low-pressure column T2 form a double column wherein high-pressure column T1 and low-pressure column T2 are thermally coupled via a condenser/reboiler E3.

6. The process according to claim 5, wherein, for keeping low-pressure column T2 cool, cooling medium is sent directly to said low-pressure column T2.

7. The process according to claim 6, wherein, for keeping high-pressure column T1 cool, cooling medium is sent directly to said high-pressure column T1.

8. The process according to claim 6, wherein, the cooling medium sent directly to low-pressure column T2 is liquefied natural gas.

9. The process according to claim 7, wherein, the cooling medium sent directly to low-pressure column T2 is liquefied natural gas.

10. The process according to claim 9, wherein, the cooling medium sent directly to high-pressure column T1 is liquefied natural gas.

11. The process according to claim 1, wherein said one or more heat exchangers E1 used for partial condensation of the feed fraction is cooled by passage there through of warm, gaseous nitrogen as the cooling medium, and said one or more heat exchangers E2 used for cooling and warming of process streams occurring in the fractionation by rectification is cooled by passage there through of cold, gaseous nitrogen as the cooling medium.

* * * * *